United States Patent [19]

Davis

[11] Patent Number: 4,460,086

[45] Date of Patent: Jul. 17, 1984

[54] TUBULAR GLASS FIBER PACKAGE AND METHOD

[75] Inventor: Richard A. Davis, Shelby, N.C.

[73] Assignee: PPG Industries, Inc., Pittsburgh, Pa.

[21] Appl. No.: 80,886

[22] Filed: Oct. 1, 1979

[51] Int. Cl.[3] ..... B65D 85/02; B65H 55/02

[52] U.S. Cl. ..... 206/389; 206/409; 206/410; 206/411; 242/170; 242/172

[58] Field of Search ..... 206/389, 53, 59, 55, 206/56, 400, 401, 409, 410, 411; 57/229, 249, 258; 28/58 B, 284; 139/387 R; 242/159, 168, 170, 171, 172

[56] References Cited

U.S. PATENT DOCUMENTS

| | | | |
|---|---|---|---|
| 1,937,468 | 11/1933 | Talbot . | |
| 2,630,280 | 3/1953 | Wedler . | |
| 2,772,773 | 12/1956 | Pestell . | |
| 2,859,135 | 11/1958 | Rossini | 57/258 |
| 3,606,656 | 9/1971 | Kunagai | 139/387 R |
| 3,669,157 | 6/1972 | Woodall | 139/387 R |
| 3,679,507 | 7/1972 | Marzocchi | 57/249 |
| 3,731,792 | 5/1973 | Rolston . | |
| 3,747,746 | 7/1973 | Newman . | |
| 3,802,953 | 4/1974 | Marzocchi | 57/249 |
| 3,915,301 | 10/1975 | Gray . | |
| 3,945,493 | 3/1976 | Cardinal . | |
| 3,953,640 | 4/1976 | Takada | 139/387 R |
| 3,983,997 | 10/1976 | Warshaw . | |
| 4,104,434 | 8/1978 | Johnson | 57/249 |

FOREIGN PATENT DOCUMENTS

| | | | |
|---|---|---|---|
| 345076 | 3/1931 | United Kingdom | 28/58 B |
| 450914 | 7/1936 | United Kingdom | 28/58 B |

*Primary Examiner*—Joseph Man-Fu Moy
*Assistant Examiner*—Brenda J. Ehrhardt
*Attorney, Agent, or Firm*—Kenneth J. Stachel

[57] ABSTRACT

Tubular packages of glass fibers having a generally cylindrical shape are provided that have a reduced tendency to slump or to collapse as the glass fibers are removed from the package. The tubular package has glass fibers wound in superimposed annular layers to form a tubular package of continuous glass fibers having a generally cylindrical shape. The tubular, generally cylindrical shaped package of glass fibers has a fibrous net on the external surface of the package of glass fibers, wherein the net is sufficient to provide support to at least the external peripheral surface of the package of glass fibers. This support can be provided by having the net composed of stiff fibrous material that is used in conjunction with strips of adhesive on the external surface of the net, or heat shrinkable fibrous material, or fibrous material with a tacky surface, or a mixture thereof. The net may cover the package of glass fibers from almost one end of the peripheral surface to almost the other end of the peripheral surface; or the entire peripheral surface; or the peripheral surface and one end of the package; or the peripheral surface and both ends of the package except where one end has an opening sufficient to allow the glass fibers to be unwound from the package. The net may be in the form of a sheet, sleeve or bag or bag with only an opening sufficient to allow the glass fibers to be removed from the package.

24 Claims, 4 Drawing Figures

TUBULAR GLASS FIBER PACKAGE AND METHOD

BACKGROUND OF THE INVENTION

The present invention is directed to a tubular package of glass fibers having reduced slumping when the glass fibers are removed from the package. More particularly, the present invention is directed to a package of continuous glass fiber strand or strands, where the strand or strands can be removed from the package from the inside of the package to the outside of the package in a facile manner so that the remaining strand in the package does not slump.

Glass fiber strands containing numerous fine individual glass fibers are produced by attenuating the glass fibers through tips in a bushing from molten glass, coating the fibers with an aqueous binder and/or size, gathering the fibers into a strand in a gathering shoe, and winding the strand around a mandrel of a winder with or without a forming tube covering the mandrel. In this process, the winder provides the attenuation forces necessary to form the glass fibers as well as serving to collect the resulting glass fiber strands. After winding, the resulting forming package is dried and the forming tube on which the package was wound, if such a tube was employed, may be removed. The dried package is now ready for further processing or for shipment to customers. Further processing of the forming packages would include the production of cylindrically shaped packages of bundles of glass fiber strands wound up in parallel without a twist. Such packages are referred to as roving packages or rovings. Rovings are made by placing a number of forming packages on a creel and collecting the strands from the package together and passing them through guide eyes and tensioning devices, and then winding the strands together as one bundle of strands onto a winding machine that is standard in the industry.

In addition to producing rovings from forming packages of glass fiber strand, the art has developed the method and necessary apparatus for formation of precision packages of glass fiber strands during the fiber forming process. In such a process the winder still provides the attenuation necessary to form the glass fiber strands from the glass fiber bushing and to collect the glass fiber strand in a cylindrically shaped package. The cylindrically shaped package would have a flat surface with flat edges on either end. The package can be one having single strand roving or one where the roving may comprise multiple strands, but in both the roving is compact at the end region of the package thereby providing the cylindrical shape to the package.

The cylindrical packages of rovings have many uses. The strand or strands from the roving can be unwound, chopped, woven, and impregnated with resin for applications such as filament winding the pultrusion. When either the roving packages from a plurality of forming packages or the packages that are precision wound during attenuation process are unwound for these various uses, the packages can be unwound from the free ends of the roving that are provided both within the interior of the package and on the exterior surface. Generally, the users of roving packages prefer to remove the roving from the package by using the interior end or ends of the roving. Several problems arise from the unwinding of strands or roving from the inside of the package. As the package is unwound, the shell of the package, i.e., the remaining strands present in overlapping layers, becomes thinner and thinner. This can eventually lead to the package becoming so unstable that the walls may finally collapse with the remaining strands becoming entangled with themselves. This results in the balance of the strand or strands from such package being discarded. Often, if the walls have not actually collapsed, the remaining package becomes so light that pulling the strand from the inside lifts the package entirely, rather than unravelling the end of the strand or strands from the package. This lifting of the package would be due to the inability of the weight of the light package to overcome the adhesive forces between the strands, which normally have binder and/or size coatings thereon. This again leads to tangles and requires the discarding of the balance of the package.

One of the art's first attempts at overcoming the problem of unwinding the strand or strands from the inside of the roving package was the use of an apparatus described in U.S. Pat. No. 2,630,280. The apparatus was a chamber wherein a square and roving package can be located. On the top of the roving package was a washer-like member that acted as a strand guide and as a restraint of vertical movement of the package. Collapse of the package was prevented by creating a vacuum in the chamber in which the roving package was located to thus force the walls of the roving package against the walls of the chamber. Such an apparatus was satisfactory but involved the use of cumbersome support apparatus such as a vacuum pump.

More recently, the art has approached this problem by several different package coverings. U.S. Pat. No. 3,731,792 (Rolston) discloses a generally tubular shaped package having glass fibers coiled in layers, where the package has a peripheral support and the last layer of glass fibers adjacent to the support is adhered to the support by a tacky or adhesive material. The support material is a sheet material which can be polyethylene coated cardboard. In addition, caps may be telescoped over the opposite ends of the package to cooperate with the sheet material and completely encase the package of the glass fibers.

It is further taught in U.S. Pat. No. 3,915,301 that a package of continuous glass filaments wrapped in layers into a generally cylindrically tubular shape can have a heat shrunk plastic film covering the peripheral and end surfaces of the tubular package.

In operations such as the preparation of sheet molding compound, gun roving spraying, pultrusion, fabric weaving, paper reinforcement and the like, it is desired by the manufacturer that the operation be maintained as a continuous process. Thus, it is desired that the glass fiber strands coming from a package be completely paid out, i.e., use all of the strand that is in the package, and when a strand package has been completely exhausted, transfer to another glass fiber package. It is also desired by the manufacturers to reach this result in the most economic and efficient manner possible.

It is an object of the present invention to provide a package of glass fibers that is unwound from the inside to the outside of the package and that has good pay out and is more economical to produce and use.

It is a further object of the present invention to provide a package of glass fiber strand or strands that is unwound from the inside layer to the outside layer of the package having a reduced tendency to collapse or slump during the unwinding of the strand.

SUMMARY OF THE INVENTION

According to the present invention a tubular, generally cylindrically shaped package of glass fiber strand or strands that unwinds from the inside of the package to the outside of the package is provided having a reduced tendency to collapse and/or slump during strand removal and having good pay-out.

The tubular, generally cylindrically shaped package of the present invention has numerous annular layers of glass fibers in the form of strand or strands or bundles superimposed one layer on top of another and has an external fibrous net that is sufficient to support at least the peripheral external surface of the last superimposed layer of glass fibers.

The superimposed annular layers of glass fibers are superimposed in any manner to form a generally cylindrically shaped roving package made to be unwound from the inside to the outside of the package. The annular layers of glass fiber strand or strands are generally of equal axial length but from time to time the layers may be shorter or longer than the preceding layer of glass fibers. The generally cylindrically shaped roving package has a flat surface at the opposite ends that are perpendicular to the peripheral portion of the package. The glass fiber strands used to form the tubular package may be any glass fiber strands known to those skilled in the art, having sizing or binding compositions and/or a coating composition. The coating composition may constitute applying a film-former to the strands as a number of strands are gathered to form a roving.

The fibrous net around the outside of the roving package provides support to at least the last layer of glass fibers in the roving package. The fibrous net can provide support by having longitudinal strips of adhesive tape placed on the outside surface of the net, by being a heat shrinkable fibrous net, or by being a fibrous net composed of fibers having a tacky coating. The fibrous net can be a sheet of netting that must be attached to itself in order to encompass the peripheral surface of the roving package, or a sleeve which can be slid over the peripheral surface of the roving package, or a bag having a peripheral surface and a bottom, or a bag having a peripheral surface and a bottom and a top surface wherein the top surface has a hole sufficient to allow the glass fiber strand or strands to be removed from the roving package. The net can be woven, if desired, or the fibers merely adhered together, e.g., by means of adhesive or thermoplastic bonds at their points of contact rather than comprising a true woven net.

The process of producing the tubular, generally cylindrically shaped package of glass fibers of the present invention will vary depending upon how the net supports at least the last superimposed layer of glass fibers. When the support is provided by having tape on the exterior surface of the net, the tape can be applied to the net either before or after the net is placed on the package of glass fibers. If the support is provided by a net made of tacky fibrous material, the package of glass fibers with such a net may only need a slight pressure applied to the net to make it contact the layer of glass fibers. If the support is to be supplied by the net being composed of heat shrinkable fibers, then the net is placed on the package of glass fibers and placed in a heating zone to shrink the fibrous net.

The glass fibers in the roving package can be an aggregate or bundle of continuous glass fibers in the form of a single strand containing a multiplicity of attenuated glass fibers or as a roving made up of any number of such strands. As a convenience in the remaining description of the invention and in the claims, the glass fibers in the roving package will be referred to as glass fiber strand. The package of continuous glass fibers has a generally cylindrical shape but may include packages of glass fibers that have an outer surface with a diameter that is greatest midway between the ends of the package and which is tapered or feathered inwardly towards each end of the package to yield a frustoconically shaped package.

DETAILED DESCRIPTION OF THE INVENTION

Figure 1:
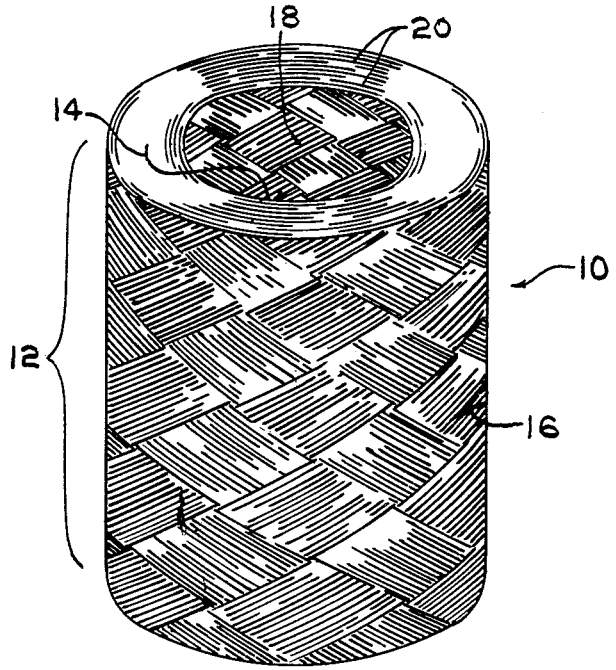
FIG. 1 is a view of a roving package of glass fiber strand.

As is shown in FIG. 1 a package of continuous glass fiber strand is composed of many layers, superimposed one on the other, of glass fiber strand, but may be composed of layers of more than one strand. The packages are usually referred to by the art as roving packages. The package 10 has a peripheral surface 12 going around the package. This roving package can be produced in any manner known to those skilled in the art so that the glass fiber strand can be unwound from the inside to the outside of the package. The inside end of the glass fiber strand depicted in FIG. 1 by 14 is removed from the package and the strand continues to be unwound from the package until the external end 16 of the glass fiber strand is reached. Also, the external end of the strand may be connected in some fashion, for example, like that shown in U.S. Pat. No. 4,097,004 (Reese), to the internal end of the glass fiber strand from another package.

The package of the continuous glass fiber strand or strands is tubular and cylindrically shaped and contains numerous layers superimposed one upon the other of a single continuous glass fiber strand or bundles of glass fiber strands wound up in parallel without a twist. These roving packages are produced in any manner known to those skilled in the art, for example, by placing a number of forming packages of glass fiber strand on a creel and collecting the strands together and passing them through guide eyes and tensioning devices and then winding the strands together as one bundle of strands onto a winding machine that is standard in the industry. In the conventional production of glass filaments or fibers into bundles or strands to be processed into roving, it is customary to use only a size or binder material with the strand. The size or binder is placed on the filaments as they are formed under the bushing from molten glass and then gathered into a strand. Any size or binder material known to those skilled in the art may be used to provide some degree of integrity or bonding for the filaments when the strands are gathered in the roving process. Rovings produced in this manner are referred to as dry rovings.

In addition, the package depicted in FIG. 1 may be a precision wound package produced directly in the fiber forming process while the winding of the package still provides the attenuation necessary to form the glass fibers from the glass fiber bushing. In this process the glass fibers are made from a multitude of fine glass filaments which are formed by being drawn at a high rate of speed from molten glass streams flowing from small openings in a bushing, which contains molten glass. The drawn glass fiber filaments are treated with a suitable sizing or binding composition from an aqueous sizing composition bath by drawing them over an applicator which places the sizing composition on the filaments. The filaments are then passed through a drying zone to reduce the moisture content and the dried filaments are gathered into a strand. The strand is wound on a winder having a horizontal traversing guide vehicle and guide eye constructed so that the edge distortion is reduced in the package being wound. The drawing of the filaments from the bushing is affected by the use of the winder which is also used to wrap the strand to form the package. The precision wound package is then removed and dried to completion in a drying oven. The foregoing describes one process for producing a precision package of glass fiber strand or roving having reduced moisture content, but other processes to produce precision packages may be used to produce a package as depicted in FIG. 1.

During the process of forming the roving package of FIG. 1, the strands may be coated with a liquid thermoplastic material. The thermoplastic coating is used on the strands to provide some degree of adhesion between the strands so that the strand can be unwound from the roving package from the inside to the outside of the package without any slumping or collapsing of the inside layers of the glass fiber strand or strands. When the roving package is a dry roving package, the liquid thermoplastic material is placed on the strands, when the strands are removed from forming packages. The strands after removal are passed through a liquid coating apparatus and gathered together and wound into a roving package. When the roving package of FIG. 1 is a precision wound roving package, the coating material can be placed on the strands with the sizing composition right after formation of the glass fiber filaments or applied to the strand produced from gathering the glass fiber filaments.

The liquid polymeric material may be any conventional film-former or conventional binder material that does not interfere with the final use of the glass fiber strands. Polymeric materials that can be used include condensation polymers, such as the injection molding grades of linear polyesters such as polyethylene terephthalate; polyamides such as polycaprolactam, polyhexamethyleneadipamide and copolyamides such as copolymers of hexamethylenediamineadipate and hexamethylenediamineisophthalate; polysulphones and copolysulphones; polyphenyleneoxides; polycarbonates; thermoplastic linear polyurethanes; and the thermoplastic derivatives of cellulose such as cellulose acetate, cellulose nitrate, and cellulose butyrate; polymers and copolymers of alpha-olefins such as high and low density polyethylenes, polypropylene, polybutene, poly-4-methylpentene-1, propylene-ethylene copolymers, copolymers of 4-methylpentene-1 with linear alpha-olefins, and ethylenevinylacetate copolymers; polymer and copolymers of vinylchloride, vinylacetate, vinylbutyral, styrene, substitute styrene such as alphamethyl styrene, acrylonitrile, butadiene, methylmethacrylate, vinylidene chloride, and the like. Also, halogenated polymers or copolymers may be used such as halogenated alpha-olefin polymers. The polymeric material is used in an aqueous solution for emulsion having a concentration of polymeric material in a range of about 1 to about 30 weight percent.

Figure 2:
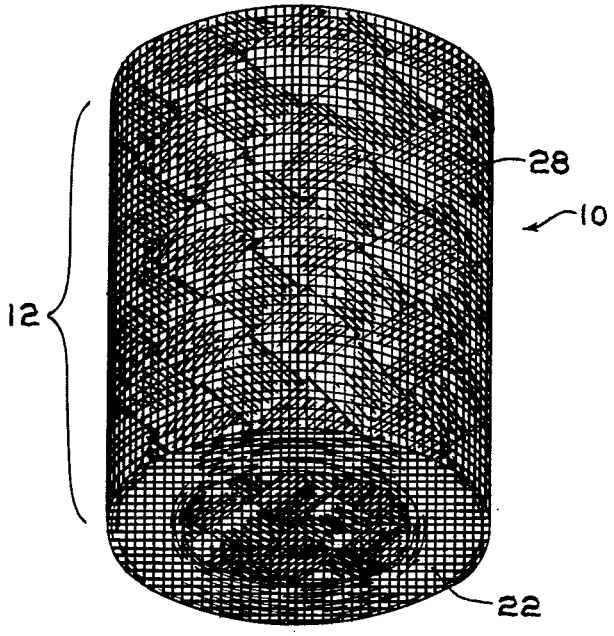
FIG. 2 is a view of the tubular, generally cylindrically shaped package of continuous glass fiber strand of the present invention showing a fibrous net covering the peripheral area of the package and the bottom surface of the package.

As is shown in FIG. 2, the package of layers of continuous glass fiber strand or strands shown in FIG. 1, can be covered with a net 28 made of fibrous material. FIG. 2 shows a package 10 with a net where the net has a peripheral section 12 and a bottom section 22. The net having this form is a netting bag. The net may be in other forms such as a net sheet that is wrapped around the peripheral surface of the package of glass fiber strands and attached to itself by some attaching means such adhesive tape or stitching or adhesive. Also, the net material may be in the form of a sleeve which is longer or shorter than the package of glass fiber strands and which is slipped onto the package. If the sleeve is longer than the package, the portion of the net draped over the package may be tucked into the core 18 of the package 10, shown in FIG. 1.

Figure 3:
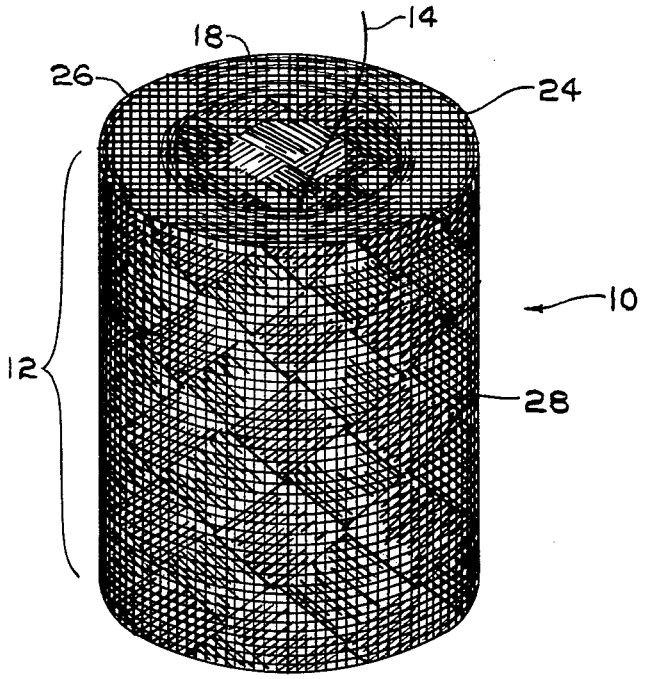
FIG. 3 is a view of the tubular, generally cylindrically shaped package of the present invention having a net on the peripheral surface of the package and the top surface having an opening to allow the unwinding of the glass fiber strands from the inside of the package to the outside of the package.

Another shape that the net may take when covering the package of glass fiber strands is shown in FIG. 3, where the net is in the form of a bag having a top section 24. The top section has an opening 26 to allow for the removal of the glass fiber strand from the inside of the package. The opening 26 may be reinforced around its rim so that the opening can act as a guide while the strand is being unwound. The net shown in FIG. 3 may or may not have the bottom section as shown in FIG. 2. If the net does have the bottom section as shown in FIG. 2, then either the top section or bottom section is independent from the remainder of the net and is attached to the remainder of the net when both are placed on the package of glass fiber strand. The attachment may be performed by any attaching means such as adhesive tape, adhesive, stitching or heat shrinking if the fibrous material is heat shrinkable, or heating if the fibrous material becomes tacky upon being heated.

The fibrous materials that can be used to make the net include those that are able to support at least the last layer of glass fiber strands in the package of glass fiber strands when the fibrous materials are made into a net. This supporting may be accomplished by the net itself, or in addition with longitudinal and/or horizontal strips of adhesive or adhesive tape on the external surface of the net or heat shrinking of the net or having the fibrous materials in the net coated with a tacky material.

When the fibrous material in the net is of sufficient stiffness and is accompanied by longitudinal and/or horizontal strips of adhesive or adhesive tape on the exterior surface of the net, the fibrous material may be any material having a similar tensile strength to thermoplastic polyester fibrous material. Non-exclusive examples of such materials include: filament polyethylene terphthalate, filament polyacrylonitrile, cellulose acetate, cellulose nitrate, regenerated cellulose (rayon), polyamide (nylon) and glass fiber strands.

The fibrous material used to construct the net may also be of a heat shrinkable polymeric material. Examples of heat shrinkable polymeric materials that may be used include polyethylene fibers, polypropylene fibers, polybutylene, polvinylchloride, polyvinylidenechloride, polystyrene, polyacrylates, linear polyesters, and polyamides.

When a heat shrinkable polymeric fibrous material is used to construct the mat, the package of continuous glass fiber strands covered with the net is placed in an apparatus to cause shrinkage which normally includes a gas or electrically heated, hot air oven which shrinks the net by exposing it to hot air. A typical shrink temperature and time is between 300° F. and 400° F. for about 10 seconds. The time and temperature will, of course, vary depending on the net and longer times may be required for lower temperatures.

The fibrous material used to construct the net may also be coated with a tacky adhesive-like coating. Nonexclusive examples of such a coating would be elastomeric coated glass fiber strands having a coating of butadiene, styrenebutadiene copolymer, neoprene, polymers with tackifying agents that form filaments, slightly cross-linked polymers, and the like. The tacky fibrous material may be coated with the tacky coating as a strand, or the strand may be made into a net and the net coated with the tacky coating.

A net constructed of any of the above-mentioned fibrous materials can be in any of the aforedescribed forms, i.e., heat, sleeve or bag. For example, the net constructed of stiff polymeric fibers, where the net has longitudinal and/or horizontal strips of adhesive tape on its external surface, can be applied to the package of continuous glass fiber strand in the form of a sheet, bag with one open end or a bag with two ends wherein one end has an opening. When this type of net is used as a bag having two ends with an opening in one of the ends, the net is placed on the package of continuous glass fiber strands either as a sheet or bag with one end and the remaining sections of the net are placed on the package and attached to the other portions of the net via strips of adhesive or strips of adhesive tape. When the net has the form of a bag with two ends where one end has an opening, and the net is constructed of tacky fibrous material or fibrous material with a tacky coating or heat shrinkable fibrous material, the bag is constructed in such a manner to allow the opening in the one end to open and close. This permits the bag to be placed on the package of continuous glass fiber strands and then the opening is closed to a smaller opening to allow the strand to be removed from the package. Then the package with the net constructed of fibrous material having a tacky coating is subjected to a pressure means to provide contact between the net and the glass fiber strands, or a heating means to make the net more tacky to provide adequate support for at least the last peripheral layer of glass fiber strand in the package. If the package with the net has a net constructed of heat shrinkable material, then the package is subjected to a step to shrink the net.

The net is constructed by warp fibers and weft fibers, and the warp fibers may be of one type of fibrous material while the weft fibers are of another type of fibrous material. The warp is the fibrous material which runs lengthwise through the net, while the weft is woven generally perpendicularly into parallel fibrous materials, the warp fibrous materials. The rectangular spaces between the parallel weft and warp fibrous materials may be of any size that will still allow the net to provide support to the package of glass fiber strand. The warp normally runs in a horizontal direction and the weft in a vertical direction. When the fibrous material is a heat shrinkable material, only the warp or only the weft or both could be constructed as a heat-shrinkable fibrous material. When only the warp or only the weft is constructed of the heat shrinkable fibrous material, the fibers used for the non-heat shrinkable fibers can be any aforementioned fibrous materials such as tacky fibrous material of fibrous materials that provide support without heat shrinking or tack. When the fibrous materials are those that are not heat shrinkable or tacky and the net constructed of these fibers is to be used in conjunction with longitudinal strips of adhesive or adhesive tape, the rectangular spaces between the warp and weft fibers must not be too large to allow too much of the adhesive or adhesive tape to contact the glass fiber strands. If the rectangular spaces are too large, too much of the adhesive will contact the glass fiber strand, and as the strand is unwound from the package by high speed textile machinery, the strand would break. It is theorized that this is caused by adhesive attaching the strand to itself or that fibers of the glass fiber strand are more firmly adhered to the adhesive than to other fibers in the glass fiber strand so that when the strand is unwound from the package the strand is broken at several random positions along the strand. At these random locations where a broken strand is present, fuzz will develop when the strand is uncoiled from the package. Fuzz at several locations may be attached to the strand and cause the strand to break. For this reason, it is also preferred when a tacky fibrous material is used in the net that the net not be composed entirely of the tacky fibrous material. Either the warp or the weft can be constructed of non-tacky fibrous material such as heat shrinkable material or support-providing fibrous material, or the warp or the weft can have interspersed non-tacky fibrous materials and tacky fibrous materials.

The net constructed in any form, i.e., sheet, sleeve, or bag with one or two ends and constructed of any of the aforementioned fibrous materials, generally uses fibrous materials in gauges of about 0.002 inch to 0.030 inch and the width of each fiber is preferably between about 1/96 and ¼ inch with about 1.5 to 5.5 fibers per linear inch.

PREFERRED EMBODIMENT

Figure 4:
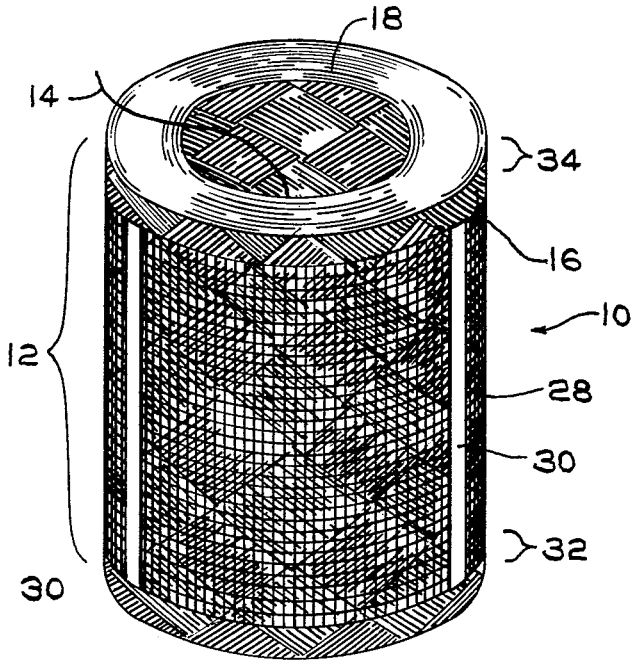
FIG. 4 is a view of the preferred embodiment of the tubular, generally cylindrically shaped package of continuous glass fiber strand having a net on the peripheral area of the roving package of glass fiber strands, where the net does not extend to the top or bottom of the package of superimposed layers of continuous glass fiber strand and wherein the net has on its exterior surface at least one longitudinal strip of adhesive tape.

The preferred embodiment of the package of glass fiber strand with a net covering is shown in FIG. 4. The package 10 has a net covering 28 around most of the peripheral surface of package 10. The inside end of the strand 14 from the core 18 is exposed at the top of the package to allow for unwinding. The outside end of the strand 16 is shown under the net 28, but can also be exposed at the top of the package to allow connecting to the inside end of the strand from another roving package. The net 28 has on its outside or external surface one or more strips of adhesive or adhesive tape 30, preferably longitudinally placed on the package. The number of longitudinal strips of adhesive can range from 1 strip to attach the net sheet to itself around the peripheral surface 12 of the package, up to as many strips as can fit around the peripheral surface of the package. The strip can be of any width, but it is usually of the width of conventional high temperature adhesive tape. The adhesive can be any adhesive known to those skilled in the art to withstand elevated temperatures, and adhesive tape can be any high temperature tape able to withstand elevated temperatures of about 100° C. It is preferred to have three longitudinal strips of high temperature adhesive tape on the exterior of the net at 120° intervals around the package and a short horizontal strip of adhesive or adhesive tape to hold the net together around the peripheral surface of the package. Although the preferred placement of the strips of adhesive on the package is longitudinally, horizontal strips of adhesive tape may also be used wherein at least three horizontal strips are used one close to the top of the package, one close to the middle of the package and one close to the bottom of the package.

The net on the peripheral surface of the package preferably does not cover the entire peripheral surface of the package, but allows for an uncovered portion of the package at the top of the package 34 and an uncovered or exposed area at the bottom of the package 32. These exposed areas prevent the problem of fuzz accumulation or breakage of the strand near the edges of the package as the strand is unwound from the package.

The net material when used with longitudinal or horizontal strips of adhesive is preferably a spun polyester net having 16 squares in a square inch with each opening being a quarter inch square and the width of the fibrous material being 1/64 of an inch. Such a polyester net is available from Industrial Engineering, Inc., Phoenix City, Ala. The net material is preferably in sheet form so that preferably a short horizontal strip or alternatively one of the longitudinal strips of tape hold the net together when it is overlapped or both free ends brought in contact with each other.

Preferably the glass fiber strands in the package constitute a roving made from numerous glass fiber strands that are coated with a film-former, when the strands are removed from forming packages on a creel and a strand from each forming package gathered and coated and wound into the roving package. Preferably the coating material is a polyester film-former such as the "Abrazade" film-former available from Proctor Chemical Company, Inc., Salisbury, N.C., having a solids content of about 6 to about 7 weight percent. The use of this film-forming coating material provides the package of glass fiber strands having an exterior surface covered with a net with good support of the layers of strands in the inner portion of the package.

The process for producing the package of the preferred embodiment of the present invention involves forming a roving package of glass fiber strands. This is done by placing forming packages of glass fiber strand on a creel; passing a strand from each forming package through guide eyes and tensioning devices and then into a coating apparatus, which can be any conventional coating apparatus for textile materials wherein the strands pick up a coating of the polyester; gathering the strands; and winding them on a mandrel to produce the roving package. The roving package is then removed and a sheet of polyester net is placed around the peripheral surface of the package to cover most of the peripheral surface and the longitudinal strips of high temperature adhesive tape are placed on the exterior surface of the net. This package may then be combined with other similar packages so that the outside end of the strands of one package is connected to the inside end of the strand from another package and then the combined roving strands are used in making sheet molding compounds, pultrusion, filament winding, and the like.

The foregoing has described a package of glass fiber strand or strands having a net covering the external surface of the package to provide support and integrity to the package. The net can be of any form, sheet, sleeve or bag with one or two ends and constructed of tacky material, heat shrinkable material, or fibrous support material used in conjunction with strips of adhesive or adhesive tape or a mixture thereof. The glass fiber strands making up the roving package of glass fiber strands can have a coating placed on the strands during formation of the roving package to provide the package with support and integrity around the inner portions of the package as the strands are removed from the package with the net covering.

I claim:

1. A tubular package of continuous sized glass fiber strand or strands having a substantially cylindrical shape, comprising:

(a) continuous glass fiber strand or strands wound into superimposed annular layers, (b) exterior fiberous net, (c) more than one strip of adhesive on the exterior surface of the net so as to allow only a portion of the adhesive to contact the glass fibers to provide minimal adhesive support to at least the external peripheral surface of the superimposed annular layers of glass fiber strand or strands, so that the glass fiber strand or strands can be removed from the package from the inside to the outside of the package with a reduced tendency for the package to collapse as the strand or strands are being removed, and with good strand payout and with minimal strand fuzzing.

2. A tubular package of continuous sized glass fiber strand or strands having a substantially cylindrical shape, comprising:

(a) continuous glass fiber strand or strands wound in superimposed annular layers, and (b) exterior fiberous net providing minimal adhesive support to at least the external peripheral surface of the superimposed annular layers of glass fiber strand or strands by being constructed of fibers or strands having a tacky surface so that the glass fiber strand or strands can be removed from the package from the inside to the outside of the package with a reduced tendency for the package to collapse as the strand or strands are being removed, and with good strand payout and with minimal strand fuzzing.

3. Tubular package according to claims 1 or 2 wherein the net is woven.

4. Tubular package according to claims 1 or 2 wherein the net is unwoven.

5. Tubular package of glass fiber strand or strands according to claims 1 or 2, wherein the continuous sized glass fiber strand or strands are treated with an aqueous coating solution containing a liquid thermoplastic material to provide integrity between the strands for support of the interior annular layers of the superimposed annular layers.

6. Tubular package of glass fiber strand or strands according to claim 5, wherein the aqueous coating solution contains a polyester resin thermoplastic material in an amount of around 6 to around 7 weight percent of the total aqueous solution.

7. Tubular package of glass fiber strand or strands according to claim 5, wherein the aqueous coating solution has microcrystalline wax emulsion present in an amount in the range of about 1 to about 15 weight percent of the solution.

8. Tubular package of glass fiber strand or strands according to claim 5, wherein the aqueous coating solution has polyvinylacetate in an amount in the range of about 1 to about 15 weight percent of the solution.

9. Tubular package according to claim 1, wherein the strips of adhesive are longitudinal strips of adhesive.

10. Tubular package according to claim 1, wherein the strips of adhesive are horizontal strips of adhesive.

11. Tubular package according to claim 1 or 9, wherein the strips of adhesive are strips of high temperature adhesive tape.

12. Tubular package according to claim 1, wherein the horizontal strips of adhesive are strips of adhesive tape.

13. Tubular package according to claim 2, wherein the net is constructed of fibers having a non-tacky surface and fibers having a tacky surface wherein the different fibers are interspersed in the warp and weft of the net or where the non-tacky fibers make up either the warp or the weft and the tacky fibers make up the other group of fibers.

14. Tubular package according to claims 1 or 2, wherein the net covers the peripheral surface and one end of the package of glass fibers.

15. Tubular package according to claims 1 or 2 wherein the net covers the peripheral surface of one end of the superimposed annular layers of glass fibers and has another end that is a circular end with an opening in the center of the circular end sufficient to allow the glass fibers to be removed from the package and wherein said circular end is attachable to the net covering the peripheral surface and the other end of the package.

16. Tubular package according to claims 1 or 2, wherein the net covers the peripheral surface of the superimposed annular layers of glass fibers.

17. Tubular package according to claim 16, wherein the net covers the peripheral surface of the superimposed annular layers almost from end to end of the peripheral surface.

18. Tubular package according to claims 1 or 2, wherein the layers of glass fibers in the superimposed annular layered package has layers having equal axial length.

19. A tubular package of continuous sized glass fiber strand or strands having a substantially cylindrical shape, comprising:

(a) continuous sized glass fiber strand or strands wound in superimposed annular layers of equal axial lengths, and (b) external fibrous net constructed of fibers selected from the group consisting of polyesters, polyacrylonitrile, cellulose acetate, celulose nitrate, regenerated cellulose, and polyamide, (c) at least one longitudinal strip of adhesive on the external surface of the net minimally contacting the exterior layers of the strands so that the net with the strip of adhesive provides minimal adhesive support to at least the external peripheral surface of the superimposed annular layers of strands so that the glass fiber strand or strands can be removed from the inside to the outside of the package with a reduced tendency for the package to collapse as the strand or strands are being removed, and with good strand payout and minimal fuzzing of the strand or strands.

20. Tubular package according to claim 19, wherein the longitudinal strips of adhesive are high temperature adhesive tape.

21. Tubular package according to claim 19 or 20, wherein the external surface of the net has three longitudinal strips of adhesive located at 120° intervals around the peripheral surface of the last superimposed annular layer of glass fibers.

22. Tubular package according to claim 19, wherein the continuous glass fibers are present as glass fiber strands that have been treated with an aqueous solution containing a polyester film-former in an amount in the range of about 6 to about 7 weight percent of the aqueous solution.

23. A tubular package of continuous sized glass fiber strand or strands having a generally cylindrical shape, comprising:

(a) continuous sized glass fiber strand or strands that have been treated with an aqueous coating solution of a polyester resin thermoplastic material wherein the polyester was present in an amount of around 6 to around 7 weight percent of the aqueous coating solution wound and that are wound in superimposed annular layers of equal axial length, and (b) exterior fibrous net constructed of polyester resin fibers that have a width of around 1/96 of an inch to around ¼ of an inch and wherein the fibers are woven to allow for 16 square spaces per square inch of the net wherein each space is around ¼ inch square, sufficient to cover the peripheral surface of the superimposed annular layers of glass fiber strands from almost the bottom of the layers to almost the top of the layers, and (c) three longitudinal strips of high temperature adhesive tape located at 120° intervals on the external surface of the net minimally contacting the exterior layers of strands so that the exterior fibrous net with the three strips of adhesive tape provides minimal adhesive support to at least the exterior layers of superimposed annular layers of strands.

24. A tubular package of continuous sized glass fiber strand or strands having a generally cylindrical shape, comprising:

(a) continuous sized glass fiber strands wound in superimposed annular layers to form a tubular, generally cylindrical shaped package, and so that the glass fiber strand or strands can be removed from the inside to the outside of the package with a reduced tendency for the package to collapse as the strand or strands are being removed, and with good strand payout and minimal fuzzing of the strand or strands.

(b) external fibrous net constructed of polyester fibers and fibers coated with an elastomeric latex, wherein the elastomeric latex coated fibers constitute the weft of the net and the polyester fibers constitute the warp of the net so that the net provides minimal adhesive support to enable the removal of the glass fiber strand or strands from the inside to the outside of the package with a reduced tendency for the package to collapse as the strand or strands are being removed, and with good strand payout from the package and with minimal fuzzing of the strand or strands.

* * * * *